United States Patent [19]

Warkentin

[11] 4,245,936

[45] Jan. 20, 1981

[54] WATER ACCUMULATOR FLUME

[75] Inventor: Aaron J. Warkentin, Orange Cove, Calif.

[73] Assignee: Pennwalt Corporation, Philadelphia, Pa.

[21] Appl. No.: 47,230

[22] Filed: Jun. 11, 1979

[51] Int. Cl.[3] ..... B65C 53/02

[52] U.S. Cl. ..... 406/137; 134/104; 134/133; 406/198

[58] Field of Search ..... 406/10, 28, 31, 76, 406/77, 81, 109, 122, 136, 137, 198; 405/60, 74, 87, 119; 209/906; 366/131, 349; 134/104, 133, 182, 183

[56] References Cited

U.S. PATENT DOCUMENTS

| | | | |
|---|---|---|---|
| 1,918,742 | 7/1933 | Elrod | 134/104 X |
| 3,786,917 | 1/1974 | Rousselie et al. | 209/906 |
| 3,981,541 | 9/1976 | Doerr et al. | 406/77 |

*Primary Examiner*—Jeffrey V. Nase

[57] ABSTRACT

A flume for transporting fruit and the like such as between a sorter and a packaging apparatus and for measuring the batches of fruit into the packaging apparatus comprises a trough for accumulating the fruit and a slowly moving paddle for directing the water flow against the fruit to transport the fruit toward an exit gate. The manner of transporting the fruit permits the use of a single production line for processing fruits of varying degrees of buoyancy, such as apples and pears, without the need for using a flotation agent in connection with the latter.

4 Claims, 6 Drawing Figures

WATER ACCUMULATOR FLUME

BACKGROUND OF THE INVENTION

The present invention relates to the processing of fruit and the like preparatory to packaging for shipment to distribution networks. More specifically, the present invention relates to a water flume which is useful in transporting measured quantities of fruits from a sorter to a packaging apparatus.

It has heretofore been standard in the food packing industry to utilize a long, shallow water flume to transport fruit, typically single layered in the flume, to a packaging station for packing into boxes. For example, flumes 60 to 80 feet long were used for sizing and transporting apples to a packaging apparatus. Shorter flumes were impractical because of the tendency of the fruit to "stack up" in the flume. Transportation of fruits or vegetables which tend to sink in water, such as pears, tomatoes, pineapples and the like has been difficult in such flumes and has typically required the use of a flotation agent to cause the product to float. Thus, the size of prior flumes and the non-interchangeability of production lines between different types of product have been major disadvantages of the prior art.

SUMMARY OF THE INVENTION

According to the present invention there is provided a water accumulator flume comprising a relatively deep tank or trough for accumulating fruit introduced thereto from a sorter and having water flowing therethrough at a relatively high velocity, and a paddle disposed therein which moves from the entrance to the exit end of the tank relatively slowly compared to the velocity of the water flow and at an angle to said flow, with its lower end preferably located six to eight inches from the bottom of the tank. The movement of the paddle is initiated by synchronized electronic signals from the sorter and the packaging mechanism to measure a desired quantity of fruit into the packaging mechanism. The movement toward the exit end of the tank of the fruit which has sunk to the bottom thereof is effected not by direct contact between the paddle and the fruit, but rather by the increased flow of water between the lower end of the paddle and the bottom of the tank, which has sufficient velocity to force the submerged fruit from the bottom of the tank and toward the exit end thereof. At the end of its travel, the paddle lifts and causes the water to accelerate the remainder of the fruit in the tank out of the exit end thereof. The paddle then lifts completely out of the tank and returns to the entrance end thereof to begin another cycle.

The flume according to the present invention can be made considerably shorter than prior flumes, because the fruit is stacked in the tank by the water flow, thus reducing the space required for processing of the fruit. Also, the flume of the present invention works equally well with fruits which float on top of the water as well as fruits which are only semi-buoyant, because the latter are forced upward and out of the tank by the increased flow of the water directed at them while the former are accelerated out of the tank at the desired rate by the force exerted thereon by the water in front of the moving paddle.

The flume according to the present invention may be adapted for use with an automatic sorter which sorts fruit and the like by weight or color, or both, such as is described in Warkentin et al., U.S. Pat. No. 4,106,628.

The packaging apparatus into which the flume of the present invention leads may be of the type described for use with apples in Warkentin U.S. Pat. No. 4,051,645.

Accordingly, it is an object of the present invention to provide a water accumulator flume for use in processing fruit and the like which will accommodate fruits which are buoyant in water as well as fruits which sink or are only semi-buoyant.

It is another object of the present invention to provide a water accumulator flume which occupies considerably less area in processing plants than prior flumes.

It is a further object of the present invention to provide a water accumulator flume whose operation is synchronized with a sorter and a packaging apparatus to measure desired quantities of fruit into the packaging apparatus.

The foregoing objects and other objects and advantages of the present invention will become apparent from the following detailed description taken in conjunction with the accompanying drawings.

DETAILED DESCRIPTION OF THE INVENTION

Figure 1:
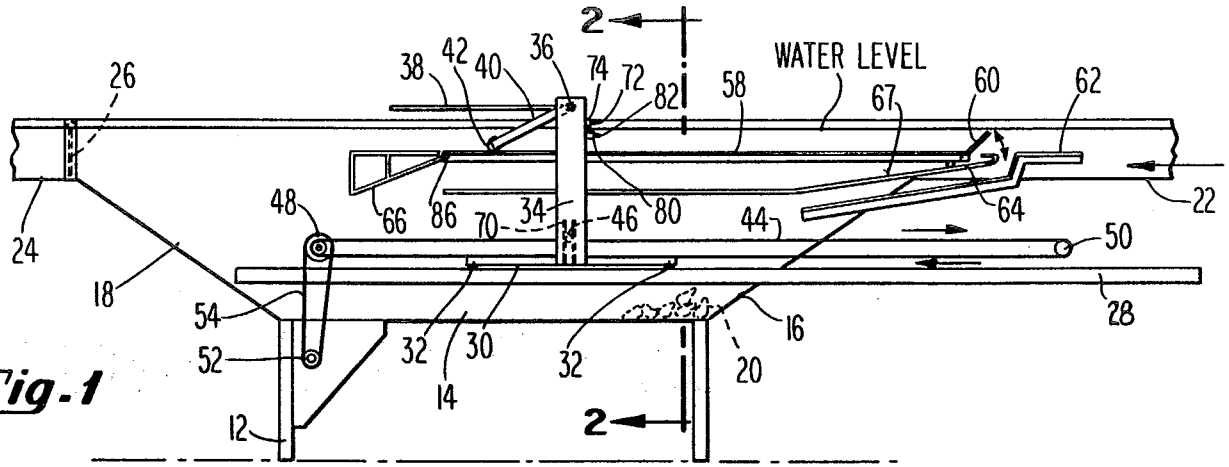
FIG. 1 is a side view of a water accumulator flume according to the present invention, illustrating the paddle thereof lifted out of the water while returning to the entrance end of the tank.

Referring first to FIG. 1, there is illustrated a water accumulator flume according to the present invention comprising a tank 10 and a suitable support structure 12. The tank 10 includes a flat primary bottom portion 14 and upwardly sloped secondary bottom portions 16 and 18. Fruit 20, such as pears or the like are illustrated as accumulated at the bottom of the tank 10.

One end of the tank 10 is connected to a shallow inlet flume 22, and the other end is connected to an outlet flume 24, with a gate 26 being positioned between the tank 10 and the outlet flume 24. Water flows from the inlet flume 22 through the tank 10 to the outlet flume 24, as indicated by the arrow in FIG. 1, and the water level, as also indicated in FIG. 1, is slightly below the top of the tank 10. The typical water flow rate for a tank of this type is on the order of 500–600 gallons per minute.

Supported on the side of the tank 10 which is viewed in FIG. 1 is a guide rail 28 on which rides a post support 30 mounted on roller bearings 32. The post support 30 supports a traveler post 34, at the top of which there is attached a paddle mount tube 36 supporting a paddle 38 which is adapted to be disposed in the water flowing through the tank 10 or, as illustrated in FIG. 1, to be supported thereabove. Also attached to the paddle mount tube 36 is a cam arm 40 to the lower end of which is connected a cam roller 42.

The traveler post 34 is connected to a moving chain 44 by a pin 46 in a manner to be described in further detail hereinafter. The chain 44 moves around sprockets 48 and 50, driven by a drive motor 52, such as a hydraulic motor, by a pulley 56.

Also mounted on the side of the tank 10, is a cam track 58 with which the cam roller 42 may engage. At one end of the cam track 58 is a track gate 60, which is pivotable as illustrated by the arrows in FIG. 1, and is adapted to contact an angle ramp 62 when the cam roller 42 passes thereover. When the track gate 60 is not weighted down by the cam roller 42 a counterweight 64 causes the track gate 60 to pivot upward. The cam track 58 also contains a cam track return portion 66 whose function will be described in greater detail hereinafter. A paddle hold-down guide 67, whose function will also be described in greater detail hereinafter, is mounted on the side of the tank 10 parallel to the angle ramp 62 as far as the ramp 62 extends and thereafter parallel to the cam track 58.

Other features of the present invention which are visible in FIG. 1 will be described in connection with more detailed views set forth in other Figures.

Figure 2:
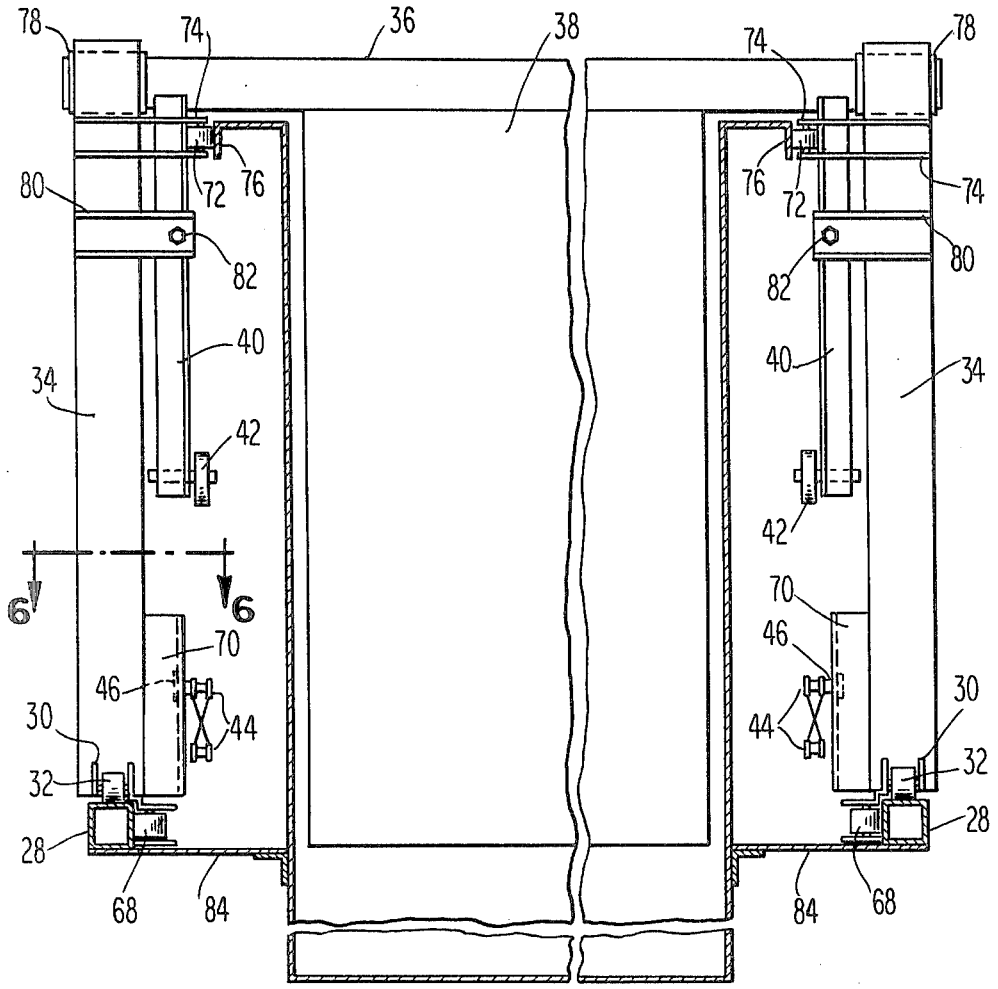
FIG. 2 is an end view of the flume of FIG. 1, illustrating the paddle submerged in the water as it would be positioned for transporting fruit through the tank.
Figure 6:
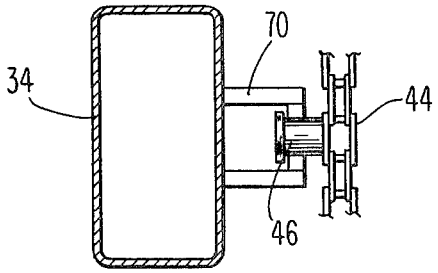
FIG. 6 is a cross-sectional view showing detail of a portion of the apparatus used to drive the paddle.

FIG. 2 is an end cross-sectional view of the tank 10 taken approximately along the line 2—2 of FIG. 1, except that for purposes of illustration the paddle 38 is shown as lowered into the tank 10, and the cam track 58, the cam track return portion 66 and the hold-down guide 67 have been omitted. As illustrated in FIG. 2, features corresponding to those previously described as mounted on the side of the tank 10 which is visible in FIG. 1 are also found on the oposite side of the tank 10. Thus, FIG. 2 shows the traveler post 34 mounted upon the post support 30, which moves on the guide rail 28 by means of the roller bearings 32. Another set of roller bearings 68 is also attached to the post support 30 and is in contact with the inner surface of the guide rail 28 to maintain the paddle 38 in proper alignment with respect to the sides of the tank 10. A slotted bracket 70 is affixed to the lower end of the traveler post 34 on the inner surface thereof, for receiving the pin 46 attached to the chain 44. Further detail of this arrangement is provided in FIG. 6, which is a cross-sectional view of the traveler post 34 showing the slotted bracket 70 attached thereto, taken along the line 6—6 of FIG. 2. From FIGS. 2 and 6 taken in conjunction, it is seen that the pin 46 is slidably received within the vertical slot of the slotted bracket 70, to provide convenient repositioning of the pin 46 with respect to the traveler post 34 when the pin 46 goes around one of the sprockets 48 or 50 in a manner to be described in greater detail hereinafter.

Also illustrated in FIG. 2 are roller bearings 72 mounted by a bracket 74 to the traveler post 34. The roller bearings 72 engage a flange 76 of the tank 10 to further assist in maintaining the relative positions of the paddle 38 and the tank 10.

FIG. 2 further illustrates the means for supporting the paddle mount tube 36, comprising a collar 78 received within the traveler post 34, within which the tube 36 is in turn received. Additionally, an adjustment bracket 80 is affixed to the traveler post 34 and carries an adjustable set screw 82 for limiting the rearward movement of the cam arm 40, as will be described in greater detail hereinafter. The guide rail 28 may be supported on the tank 10 by any suitable means, such as a bracket 84.

The operation of the apparatus according to the present invention is illustrated in FIGS. 1 and 3–5. Referring again to FIG. 1, the arrows along the chain 44 illustrate the direction of movement thereof and as the pin 46 is shown in the upper part of the chain 44, the traveler post 34 engaged therewith is moving in the same direction as the upper part of the chain 44, that is, from left to right in FIG. 1. The cam roller 42 is engaged with the cam track 58, maintaining the paddle 38 entirely out of the water in the tank 10, in a position roughly parallel to the water surface.

Figure 3:
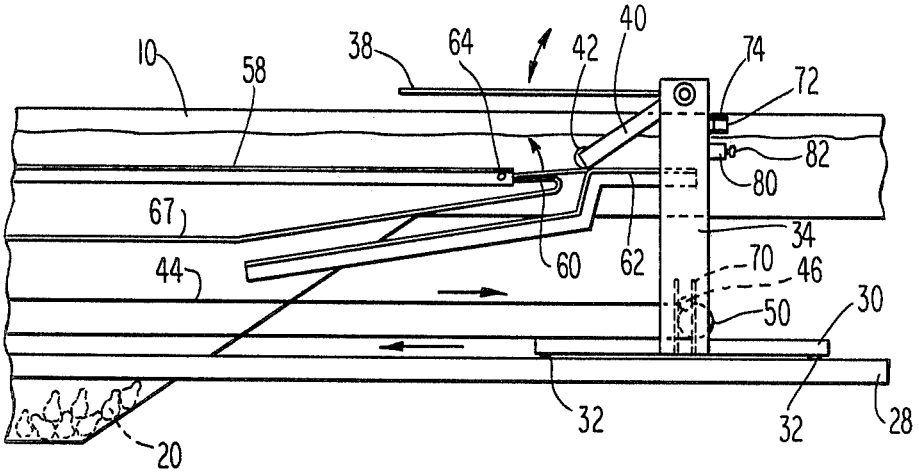
FIG. 3 is a partial side view of the entrance end of the flume of FIG. 1, illustrating the paddle just prior to entering the water in the tank.

FIG. 3 illustrates that as the traveler post 34 nears the right hand sprocket 50, the cam roller 42 reaches the end of the cam track 58 and encounters the track gate 60, causing the latter to pivot downward to permit the cam roller 42 to travel thereacross to the angle ramp 62. When the cam roller 42 disengages from the track gate 60, the latter repivots upward in the direction indicated by the arrow in FIG. 3 under the influence of the counterweight 64. Next the pin 46 rotates around the sprocket 50 and thus slides vertically downward within the slotted bracket 70, so that the direction of travel of the traveler post 34 is reversed. The track gate 60 having swung upward, it is understood that as a result this reversed motion, the cam roller 42 will engage the angle ramp 62, thus causing the paddle 38 to be gradually lowered into the water in the tank 10 as the traveler post 34 moves from right to left. The hold-down guide 67, positioned above the cam roller 42, prevents the paddle 38 from being raised under the influence of the water flow and thus maintains the desired attitude of the paddle 38 in the tank 10.

Figure 4:
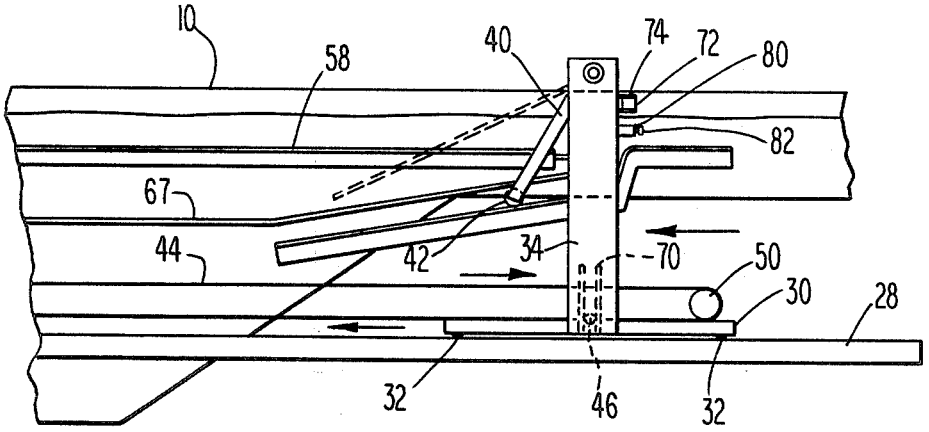
FIG. 4 is a partial side view as in FIG. 3, illustrating the paddle just after entering the water.

In FIG. 4, the paddle 38 is shown partially lowered into the water in the tank 10, as the cam roller 42 moves along the angle ramp 62 from right to left. It will be noted that the pin 46 is now on the lower part of the chain 44, having gone around the sprocket 50, and therefore has become relocated at a lower position within the slotted bracket 70. When the cam roller 42 reaches the end of the angle ramp 62, the paddle 38 is lowered fully into the tank 10 and is held in this position by the hold-down guide 67 against the current flow. Further rearward movement is prevented by the set screw 82. In the fully lowered position, the paddle is preferably at an angle of approximately 85 degrees with respect to the direction of water flow through the tank 10. The paddle 38 also is preferably one-half to one inch from the sides of the tank 10 to prevent the passage of fruit therebetween, and approximately six to eight inches from the bottom thereof.

According to the well known principles of fluid dynamics, the restricted passageway for the water flow through the tank 10 created by the presence of the paddle 38 therein, which comprises essentially the area between the lower end of the paddle 38 and the bottom of the tank 10, causes the water flowing therethrough to move at a much higher velocity than in the remainder of the tank for an equivalent volume of water. Thus, there is created a strong "jet" of water between the lower end of the paddle 38 and the bottom of the tank 10, and because the paddle 38 is at an angle with respect to the bottom of the tank 10, this jet is directed downward at an angle toward the bottom of the tank 10. The effect of this downwardly directed water jet is to cause any fruit which may have sunk to the bottom of the tank 10 to be forced upward therefrom and toward the outlet end of the tank 10. Thus the flume of the present invention is operable to transport fruits which tend to sink in water, such as pears, by the water jet action just described, as well as to move floating fruit, such as apples, by mechanical pressure of the paddle 38 as it travels through the tank 10.

Figure 5:
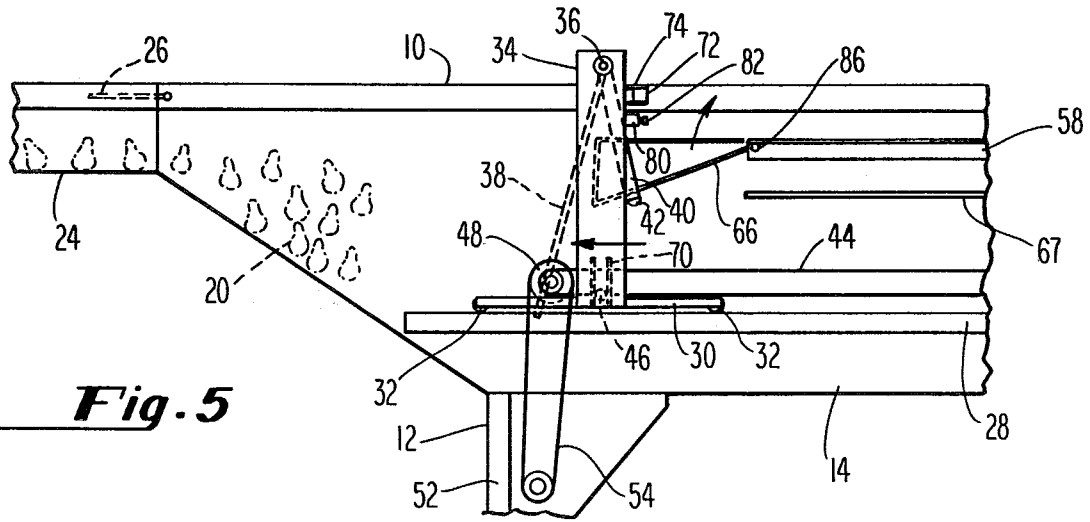
FIG. 5 is a partial side view of the exit end of the flume of FIG. 1, illustrating the manner of urging the fruit out of the tank and of lifting the paddle out of the water.

In FIG. 5, the paddle 38 is shown as it is nearing the end of its travel through the tank 10. At this point, the cam roller 42 engages with the cam track return portion 66 of the cam track 58, causing the cam track return portion 66 to be lifted upward by pivoting about a pivot point 86 (see also FIG. 1) in the cam track 58. As the cam roller 42 passes the end of the cam track return portion 66, the latter re-pivots downward to its normal position, and shortly thereafter the pin 46 travels around the sprocket 48 to again change the direction of the traveler post 34. Almost immediately the cam roller 42 encounters the vertical side of the cam track return portion 66, quickly lifting the paddle 38 out of the tank 10 and thereby accelerating the removal of any remaining fruit from the tank 10. With the paddle 38 out of the water, the traveler post 34 then returns to the entrance end of the tank 10 to repeat the above process.

Suitable actuating devices, such as relays and the like, are preferably included in the apparatus described herein to synchronize the operation thereof with that of the fruit sorter and the fruit packer. Specifically, it is desirable that near the beginning of the travel of the paddle through the water, the movement of the paddle be stopped so as to permit a measured quantity of fruit to accumulate therebehind. Upon a signal from the packer that it is prepared to accept the fruit accumulated ahead of the paddle, the paddle is then caused to go forward through the tank. At the same time, a signal causes the gate 26 to open, permitting the fruit to exit therethrough.

The drive motor 52 is preferably a variable speed hydraulic motor to permit the processing of various products under a variety of conditions. The tank 10, including the upwardly sloped portions thereof, is preferably on the order of 10 feet long and the shallow inlet flume 22 supplying fruit thereto should also be approximately 10 feet long. In its central portion, the tank 10 is preferably approximately 28 inches deep. For a tank 10 feet in length, the paddle should preferably take approximately 30 to 40 seconds to traverse the length thereof in one direction.

It will thus be apparent that there has been provided by the present invention an apparatus for effeciently transporting fruits and vegetables of various types in a single device, which requires much less operating area than previous such transport systems. Although the present invention has been illustrated and described with respect to a presently preferred embodiment thereof, many variations and modifications of the concepts disclosed herein would be apparent to those skilled in the art, and it is intended that all such variations and modifications be encompassed within the scope of the appended claims.

I claim:

1. Apparatus for water transport of fruit and the like comprising a tank adapted to permit water to flow therethrough and to receive fruit introduced therein, flow restricting means adapted to be disposed in said tank for restricting the flow of water therethrough and directing said restricted water flow toward the bottom of said tank, and means for causing said flow restricting means to traverse the length of said tank in the same direction as the water flow therethrough to urge fruit through and out of said tank.

2. Apparatus for water transport of fruit and the like comprising a tank adapted to permit water to flow therethrough and to receive fruit introduced therein, a paddle adapted to be disposed in said tank at an angle to the flow of water therethrough to restrict said water flow and to direct said restricted water flow at an angle against the bottom of said tank, and means for causing said paddle to traverse the length of said tank in the direction of the water flow therethrough to urge fruit through and out of said tank.

3. Apparatus for water transport of fruit and the like, including such fruit as normally tend to sink in water, comprising a tank adapted to permit water to flow therethrough and to receive fruit at one end and discharge fruit at the other end, means for introducing said fruit into said tank at said receiving end, and means for urging said fruit through said tank and out of said discharge end, comprising a solid paddle adapted to be disposed in said tank at an angle to the flow of water therethrough to restrict said water flow substantially to the area between the lower end of said paddle and the bottom of said tank, thereby creating a water jet directed at an angle against said bottom of said tank to force fruit disposed thereon in the direction of said water jet, and means for causing said paddle to move through said tank from said receiving to said discharge end.

4. Apparatus as in claim 3 further characterized by return means for returning said paddle from said discharge end to said receiving end of said tank, said return means including said means for causing said paddle to move through said tank from said receiving end to said discharge end, and cam track return means disposed within said tank at said discharge end thereof cooperating with said means for causing said paddle to move through said tank from said receiving end to said discharge end whereby upon approaching said discharge end by said paddle, said cam track return means is actuated to thereby cause said paddle to return to said receiving end.

* * * * *